United States Patent [19]

Smith et al.

[11] Patent Number: 4,563,855

[45] Date of Patent: Jan. 14, 1986

[54] APPARATUS FOR PACKAGING AN EDIBLE LIQUID

[75] Inventors: Lewis W. Smith; Eric T. Warburton, both of Peterborough, Canada

[73] Assignee: Innopac Inc., Toronto, Canada

[21] Appl. No.: 581,534

[22] Filed: Feb. 21, 1984

[30] Foreign Application Priority Data

Oct. 17, 1983 [CA] Canada ..... 439155

[51] Int. Cl.[4] ..... B65B 55/10

[52] U.S. Cl. ..... 53/128; 53/426; 53/282; 53/300; 53/389; 53/546; 422/303; 426/408

[58] Field of Search ..... 53/426, 128, 546, 282, 53/281, 300, 389; 422/303, 304; 426/408, 407, 397, 399

[56] References Cited

U.S. PATENT DOCUMENTS 3,783,581 1/1974 Pierce ..... 53/282 X
4,035,981 7/1977 Braun et al. ..... 53/426 X
4,077,180 3/1978 Agent et al. ..... 53/282 X
4,409,775 10/1983 Brody et al. ..... 53/426 X

FOREIGN PATENT DOCUMENTS 1002497 6/1979 Canada .
54-44988 4/1979 Japan .

*Primary Examiner*—James F. Coan
*Attorney, Agent, or Firm*—Ridout & Maybee

[57] ABSTRACT

The invention relates to an apparatus for packaging an edible liquid in individual sterilized containers. The apparatus comprises a conveyor for the containers wherein the containers are sterilized on the lower level thereof and then are filled and sealed on the upper level thereof. The sealing means comprises the use of a pay-out wheel to feed a ribbon of sterile cover stock over an idler wheel and onto a heated sealing wheel. The pay-out and sealing wheels are provided with indexing buttons for the ribbon of cover stock to ensure precise registration thereof onto the containers.

31 Claims, 9 Drawing Figures

APPARATUS FOR PACKAGING AN EDIBLE LIQUID

The present invention relates to an apparatus for packaging an edible liquid in individual sterilized containers. The apparatus particularly relates to the packaging of small quantities, i.e. 10 ml of milk or cream in sterile plastic containers for use in restaurants or the like, but the apparatus may also be used for packaging quantities of liquids up to about 200 ml.

Prior devices utilize a conveyor for moving containers at one level from station to station for the purpose of effecting the various steps comprising the packaging of liquids. The present apparatus utilizes the lower level of an endless conveyor to effect sterilization of the containers prior to the filling and sealing steps which take place on the upper level of the conveyor. This container sterilization step is carried out by introducing the containers onto the conveyor in an inverted position so that the interiors thereof can be chemically sterilized, drained and dried readily immediately prior to filling.

The present apparatus also provides an improved heat sealing station for applying a ribbon of cover stock to the filled containers. This improved sealing means comprises the use of a payout wheel to feed cover stock over an idler roller and onto a heated sealing wheel. This arrangement ensures an even heating of the cover stock and a precise registration of the cover stock being applied to the containers, thereby providing a reliable liquid seal.

Accordingly, the present invention provides an apparatus for packaging an edible liquid in sterile, sealed containers, comprising an endless conveyor having upper and lower levels by which at least one row of containers are conveyed through the apparatus. Inverted containers are fed onto the lower level of the conveyor preferably by means of a toothed feeder wheel and are chemically sterilized as they move along the lower level. The sterile containers are filled with liquid as they move along the upper level of the conveyor by known filling means. The filled containers are then sealed by means, comprising for each row of the conveyor, a ribbon of sterile cover stock having a heat sensitive adhesive thereon, which is fed over a payout wheel and onto a heated sealing wheel for application to the containers. A cutoff wheel for each row of the conveyor is located after the heated sealing wheel for severing the connecting ribbon of cover stock between containers.

A preferred embodiment of the invention will hereinafter be described with reference being made to the drawings in which.

Figure 1:
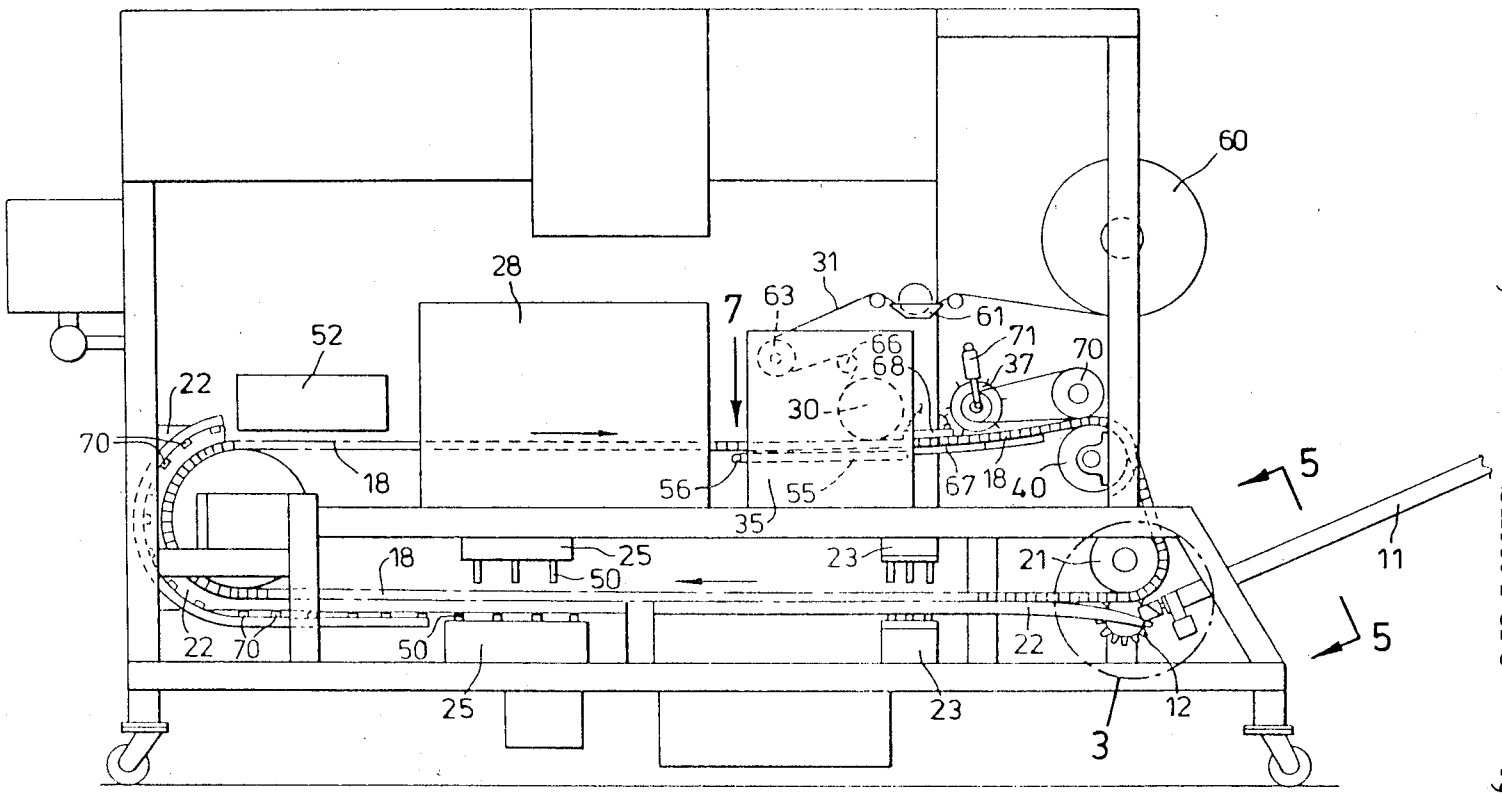
FIG. 1 is a side elevation of the preferred apparatus of the invention.
Figure 4:
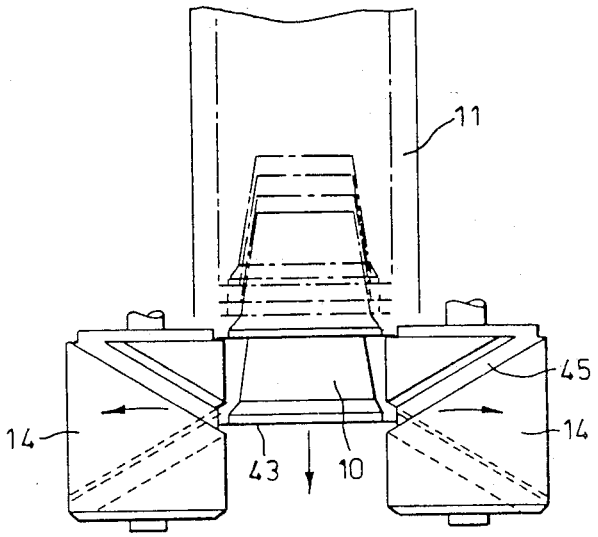
Figure 2:
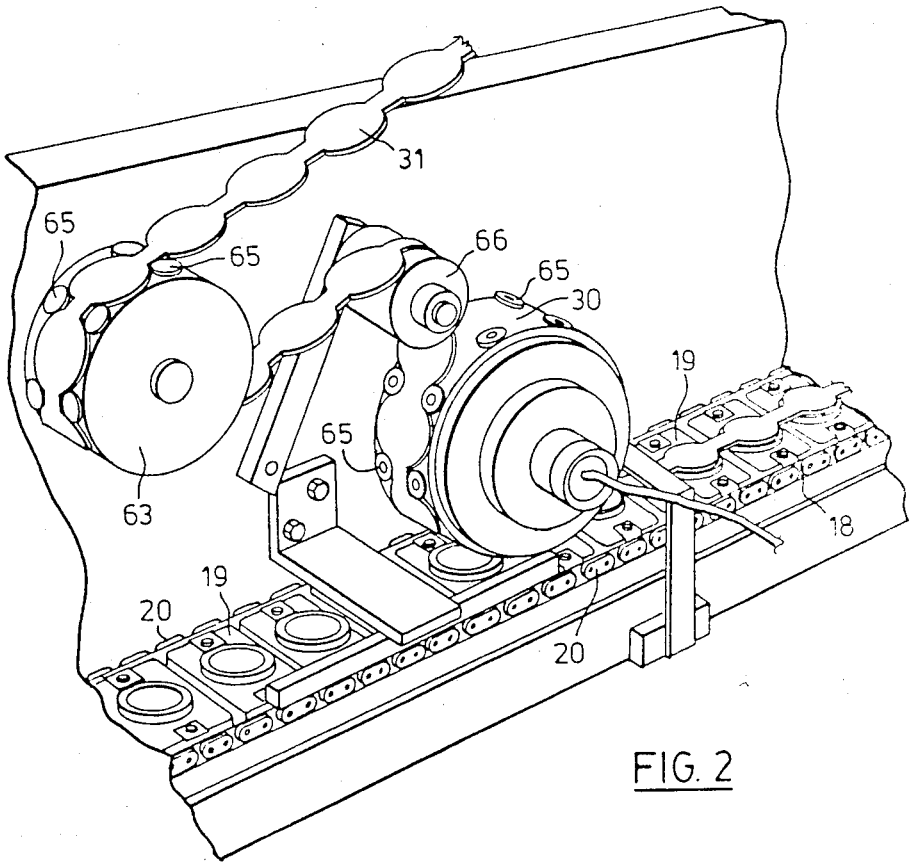
FIG. 2 is a detailed perspective view of the sealing section of the apparatus of FIG. 1.
Figure 3:
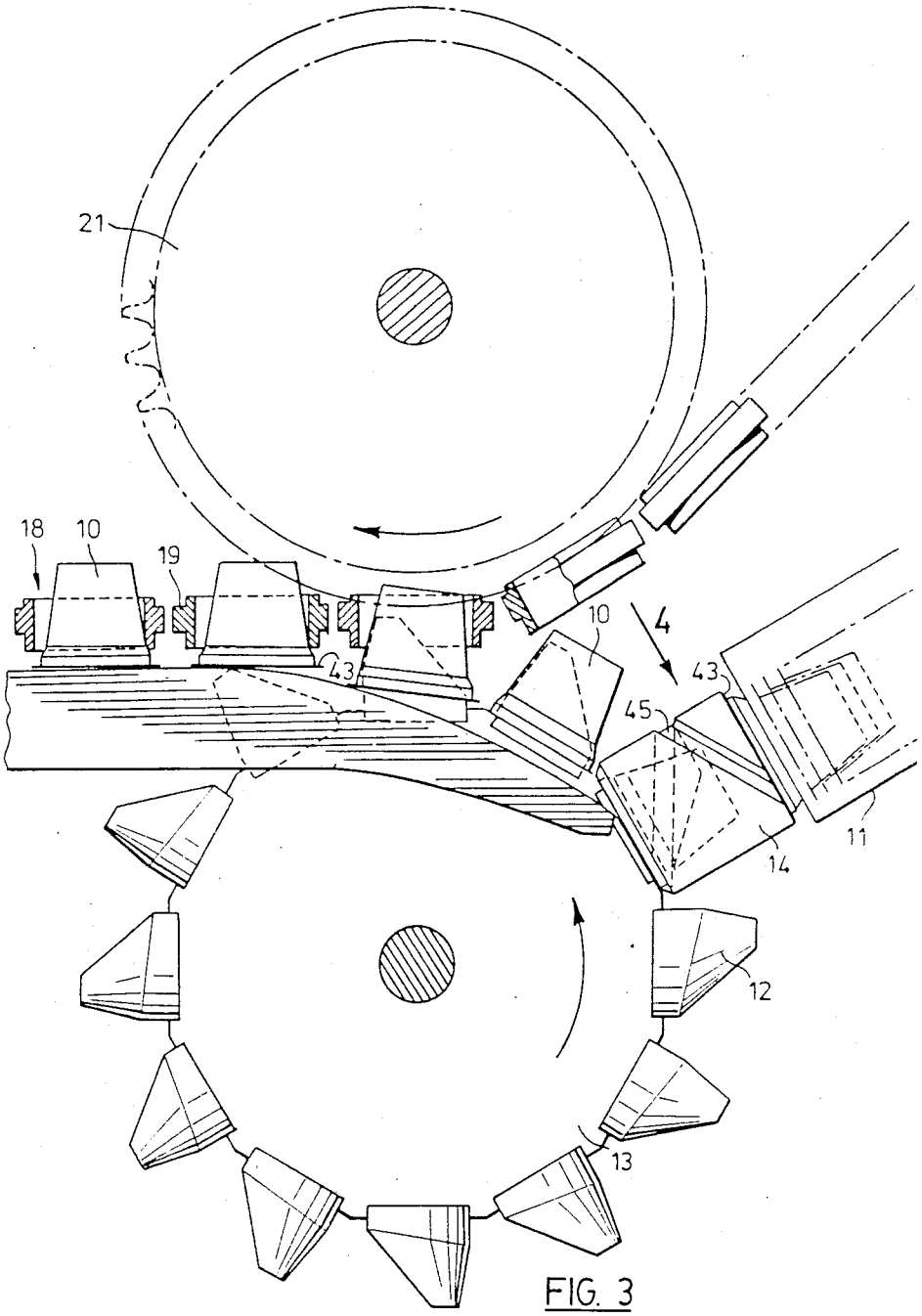
FIG. 3 is a detailed side elevational view of the feed means for cups onto the lower level of the conveyor.
Figure 5:
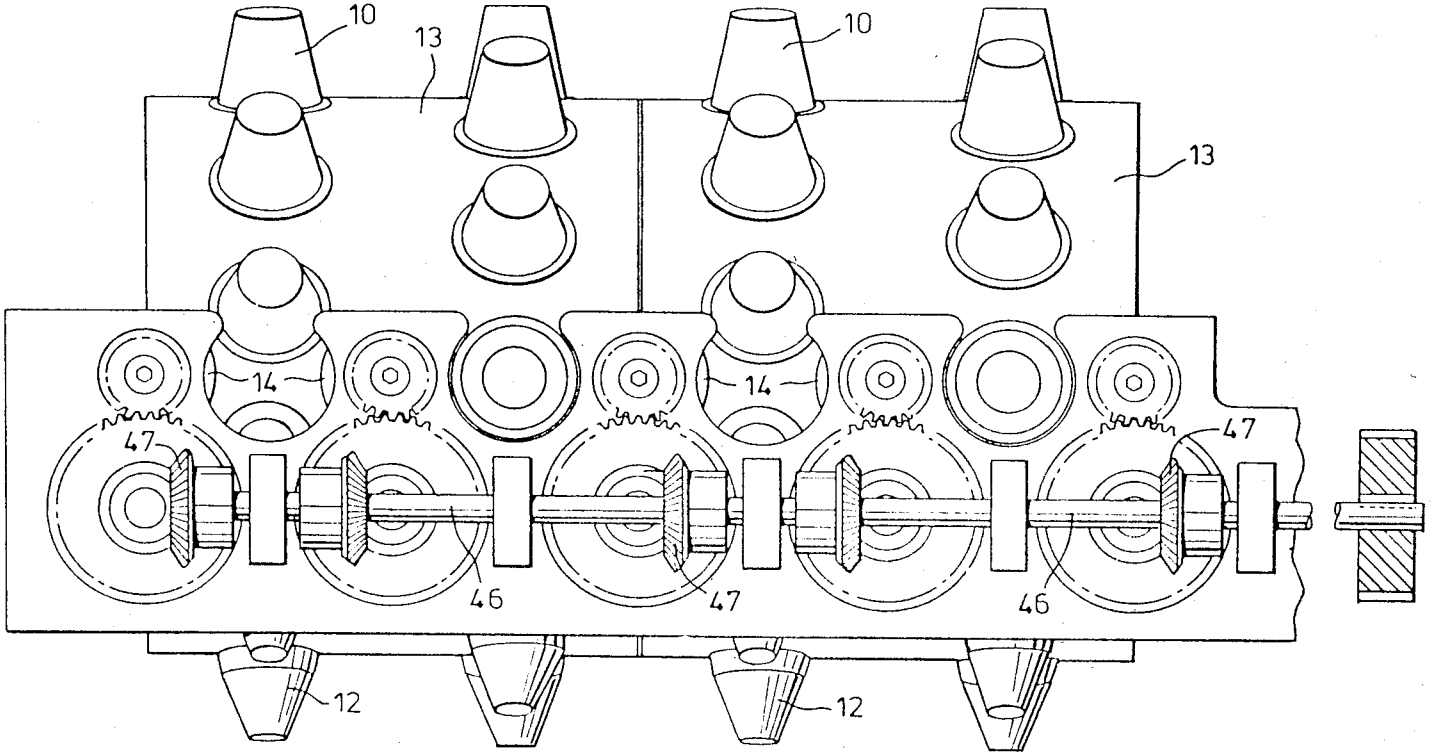
Figure 6:
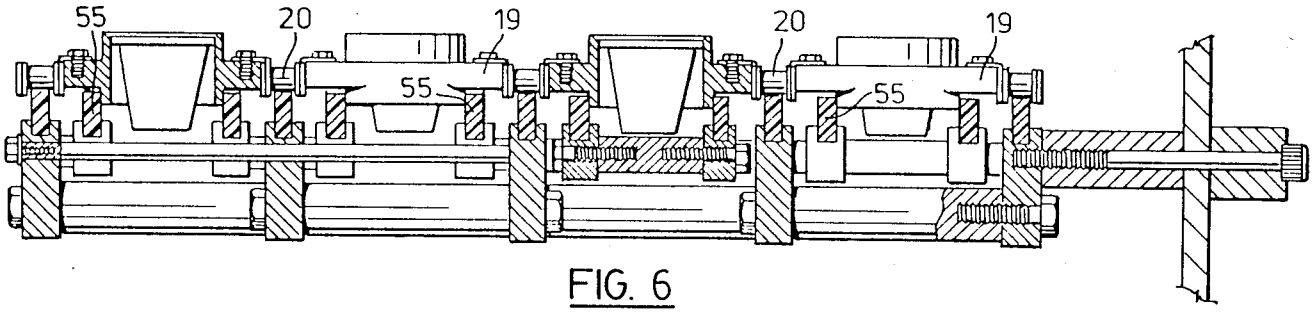
Figure 7:
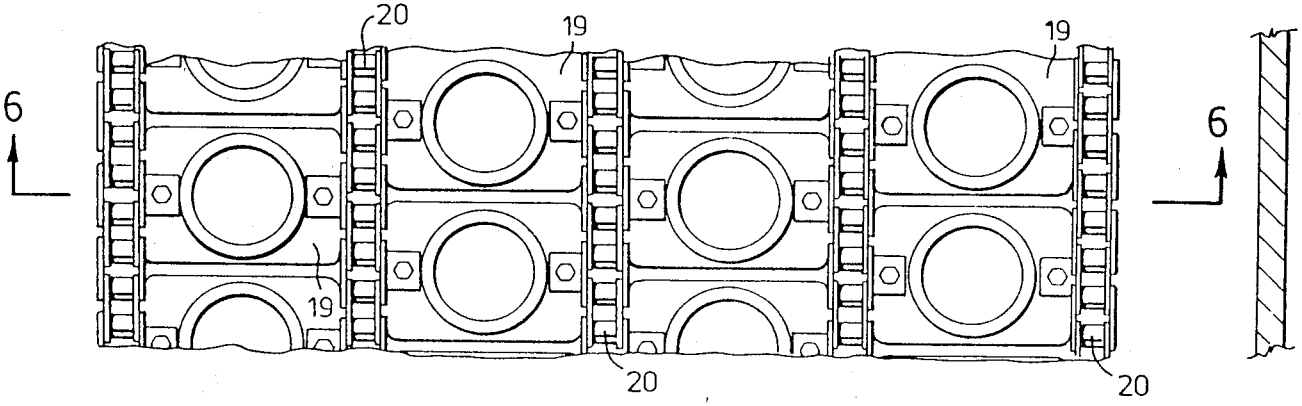
Figure 8:
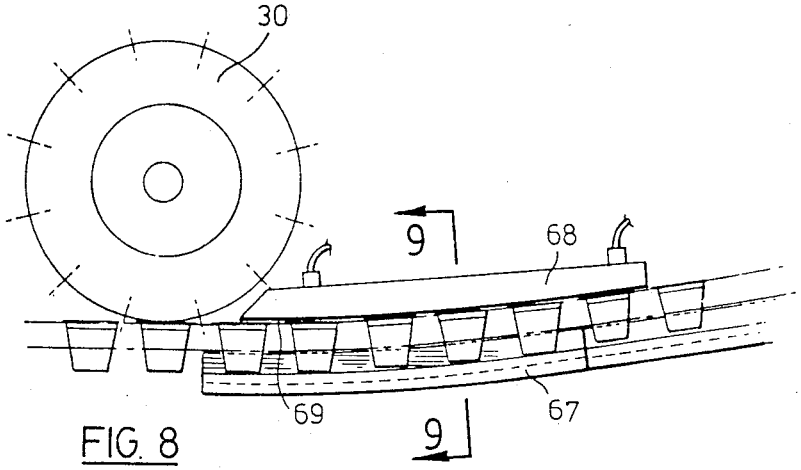
Figure 9:
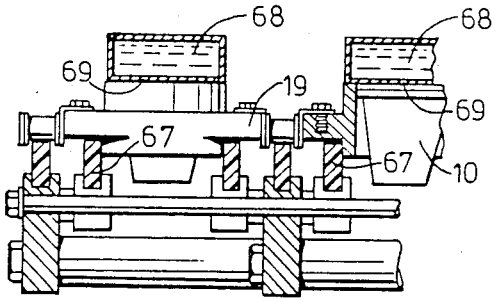

FIG. 4 which is found on the same sheet as FIG. 2 is a view taken along line 4 in FIG. 3 showing the escapement wheels which act to sequentially place cups on the teeth of the feeder wheel shown in FIG. 3;

FIG. 5 is a section taken along line 5—5 of FIG. 1 showing the feed means of a preferred apparatus having four rows of cups;

FIG. 6 is a cross-sectional view taken along line 6—6 of FIG. 7 showing details of the conveyor for a four row apparatus;

FIG. 7 is an overhead view of the four row conveyor along line 7 of FIG. 1;

FIG. 8 is a side elevation of a section of the conveyor just passed the heated sealing wheel showing details of the cooling shoe and convex ramp; and FIG. 9 is a sectional view of the conveyor, cooling shoe and convex ramp taken along line 9—9 in FIG. 8.

The overall operation of the preferred apparatus of the invention may be appreciated by reference to FIG. 1. While most of the drawings relate to an apparatus having a single row of cups for filling, the preferred apparatus in its commercial embodiment has a plurality of rows and optimally four.

From FIGS. 1 and 3 it can be seen that cups 10 are stacked in a chute 11 and fed individually onto the teeth 12 of a feeder wheel 13 by a pair of escapement wheels 14.

As the feeder wheel 13 moves counterclockwise from the escapement wheels 14, the inverted cups 10 are captured by a conveyor 18 which comprises a plurality of collars 19 attached to parallel chains 20 (FIG. 2) driven by a sprocket wheel 21. The cups 10 are conveyed along a pair of parallel rails 22 to a chemical sterilization station 23 where the cups 10 are sprayed with a suitable sterilizing solution such as 35% hydrogen peroxide. The inverted cups 10 drain as they are conveyed to a drying station 25 where heated air is forced over the interior and exterior surfaces of the cups thereby drying them.

The sterile cups 10 are conveyed on the rails 22 around the end of the conveyor 18 to the upper level of the conveyor 18 where they are filled with the desired edible liquid at a filling station 28 and then capped by a heat sealing wheel 30 with a ribbon of sterile cover stock 31 fed in register onto each cup by a sealing means 35. The cover stock 31 sealed onto the cups 10 is severed by a cutoff wheel 37 and the now filled and sealed cups 10 are conveyed from the apparatus by an ejector wheel 40.

Referring now to the various stations of the apparatus in greater detail, FIGS. 3, 4 and 5 illustrate details of the cup feeding mechanism. The inverted cups 10 are stacked in a chute 11 from which they are removed one at a time by a pair of escapement wheels 14. The wheels 14 engage the lip or rim 43 of each cup 10 in the spiral groove 45 provided in each wheel 14. The groove 45 causes each cup 10 to travel from the chute 11 onto a tooth 12 of the feeder wheel 13 in a sequential fashion. The feeder wheel 13 immediately transports each cup 10 onto a pair of parallel rails 22 where the cups 10 are supported by their rims 43 and are sequentially captured by the collars 19 of the conveyor 18 which then assumes the control over the movement of the cups 10 to the various stations of the apparatus. Clearly, the speed of movement of the wheel 13 is matched to the speed of the conveyor 18 so that each tooth 12 of the wheel 13 can sequentially deliver a cup 10 to each successive collar 19 of the conveyor 18. Likewise the rotation of the escapement wheels 14 is adjusted to the rotational speed of the wheel 13 so that one cup 10 is deposited on each successive tooth 12 of the wheel 13 which passes therebetween.

It should be noted that the preferred embodiment comprises several rows of cups 10, and preferably the commercial apparatus has four rows. As can be seen from FIG. 5, adjacent rows of cups 10 preferably use an escapement wheel 14 commonly. A shaft 46 is provided with gears 47 for rotating adjacent escapement wheels 14 in opposite directions. This means that the cups 10 in adjacent rows descend onto their respective feeder wheels 13 at different times. In the preferred case illustrated in FIG. 5, when the first row cup is down on a tooth 12 of the feeder wheel 13, the cup 10 in the adjacent row is only half way down onto a tooth 12 of its feeder wheel 13. This means that the conveyors 18 of adjacent rows must be adjusted accordingly as shown in FIGS. 6 and 7.

The inverted cups 10 are conveyed along the rails 22, which are preferably made of a plastic material, by the conveyor 18 to the chemical sterilizing station 23 and then to the drying station 25. Because the cups 10 are inverted, the sterilization procedure may be carried out more quickly than is the case with other devices since the solution used to sterilize the cups 10 quickly drains from the interiors thereof, and the cups 10 may be quickly dried upon a short exposure to the heated air of the drying station 25. At the drying station 25 air at a temperature of approximately 100° C. is forced through a series of nozzles 50 onto all surfaces of the cups 10 as they pass through.

From the drying station 25, the cups are conveyed along the rails 22 around the end of the conveyor 18 to the upper level of the conveyor 18 where the cups 10 are situated upright in the collars 19 which engage and support the cups 10 at the underside of the rims 43 thereof. In order to ensure sterility of the rims 43, the cups 10 may be held from contacting the rails 22 by means of sterile air forced through a series of nozzles 70. The cups 10 may then pass beneath an ultraviolet light 52 before moving on to the filling station 28.

The liquid filling station 28 may be of any suitable design familiar to those experienced in this art. Preferably, the cups 10 are filled at the station 28 by means of a multiple nozzle filler which travels along with several cups 10 until the desired volume has been introduced into each cup 10 at which time the filler moves back to the next group of cups and repeats the process. For a high speed machine as in the present case, a five nozzle filler is preferred.

The filled cups 10 are conveyed to the sealing station 35 (FIGS. 1 and 2) where a ribbon of sterile cover stock 31 is applied by the heated wheel 30. The cover stock is provided with a heat sensitive adhesive. In moving up to the heat sealing wheel 30, the conveyor 18 proceeds along parallel arms 55 which comprise a ramp for raising the cups 10 into good contact with the surface of the wheel 30 upon application of the cover stock 31 thereto. The arms 55 may be made of a high density polyethylene having a low coefficient of friction with respect to the conveyor 18. The arms 55 are raised or lowered about pivots 56 by air cylinders (not shown). Generally, the angle of the ramp 55 above horizontal is only on the order of 1°.

The cover stock 31 is fed as a ribbon from a spool 60 through a chemical sterilization bath 61 which preferably contains a constant flow of 35% hydrogen perioxide. From the bath 61, the cover stock 31 travels over a payout wheel 63 which is equipped with indexing buttons 65 corresponding to the spacing or pitch of the individual covers. The buttons 65 serve to accurately feed the cover stock 31 over an idler wheel 66 onto the larger heat sealing wheel 30 which is also equipped with indexing buttons 65 so that the individual covers are applied in register with the rims 43 of the cups 10 passing beneath the wheel 30. It has been found that without the controlling effect of the payout wheel 63 and the indexing buttons 65, the cover stock 31 cannot reliably be applied to the individual cups 10 with the tolerance needed for a high speed capping operation as in the present case.

From the heat sealing wheel 30, the cups 10 proceed preferably along an upwardly concavely curved ramp comprising arms 67 which engage the collars 19 in the same manner as the arms 55 (see FIGS. 8 and 9). The arms 67 serve to tilt the collars 19 slightly toward one another in a gentle arc so that tension on the ribbon of cover stock 31 sealed to the cups 10 is relieved prior to the severing operation. Additionally, it is preferable to provide a cooling shoe 68 which just contacts the sealed ribbon of cover stock 31 immediately after the heated sealing wheel 30 for the purpose of fixing the adhesive forming the seal about the rims 43 of the cups 10. The cooling shoe 68 has a lower surface 69 curved to conform to the curvature of the arms 67. The cooling shoe 68 may conveniently be made of aluminum and is hollow to allow for a flow of coolant such as water therethrough.

The cups 10 proceed along the curved arms 67 to a cutoff wheel 37 where the ribbon of cover stock 31 is severed between the cups 10. The cutoff wheel 37 is of conventional design and has its own drive 70. The wheel 37 may be raised and lowered when setting up the machine by means of an air cylinder 71. The arms 67 may continue passed the cutoff wheel 37 but do not need to be curved after the ribbon 31 is severed.

The individual sealed cups 10 are conveyed from the cutoff wheel 37 over an ejectment wheel 40 where they are ejected from the collars 19 of the conveyor 18 into a collecting chute for further packaging steps.

What is claimed is:

1. An apparatus for packaging an edible liquid in sterile, sealed containers having rims about the openings thereof, comprising:

an endless conveyor having upper and lower levels by which at least one row of containers are conveyed through the apparatus;

means for feeding inverted containers onto the lower level of the conveyor which is provided with parallel rails for supporting the containers by the rims thereof, comprising escapement wheels for delivering individual inverted containers onto individual teeth of a feeder wheel which in turn feeds each inverted container onto the lower level of the conveyor;

means for chemically sterilizing the containers as they move along the lower level of the conveyor;

means for filling the sterile containers with the liquid as they move along the upper level of the conveyor;

means for sealing the filled containers about the rims thereof, comprising a ribbon of sterile cover stock having a heat sensitive adhesive thereon, being fed over a payout wheel onto a heated sealing wheel for application to the containers; and a cutoff wheel located after the heated sealing wheel for severing the connecting ribbon of cover stock between containers.

2. An apparatus as claimed in claim 1, wherein the conveyor comprises a plurality of collars for engaging the rims of the containers, said collars being attached between two parallel chains commonly driven by a sprocket wheel.

3. An apparatus as claimed in claim 1, wherein the conveyor comprises four rows.

4. An apparatus as claimed in claim 1, further comprising a cooling shoe just contacting the tops of the sealed container located immediately after the heated sealing wheel.

5. An apparatus as claimed in claim 1, wherein the means for chemical sterilization comprises a plurality of nozzles for spraying all surfaces of the containers with a suitable sterilizing solution.

6. An apparatus as claimed in claim 5, wherein the sterilizing solution is about 35% hydrogen perioxide in water.

7. An apparatus as claimed in claim 1, further comprising means for drying the containers after they have been chemically sterilized but before they are filled.

8. An apparatus as claimed in claim 7, wherein the drying means is located on the lower level of the conveyor.

9. An apparatus as claimed in claim 7, wherein the drying means comprises a plurality of nozzles through which hot air is forced onto the containers as they moved along by the conveyor.

10. An apparatus as claimed in claim 9, wherein the nozzles are located both above and below the containers and the hot air is about 100° C.

11. An apparatus as claimed in claim 1, further comprising a plurality of nozzles through which sterile air is directed against the containers as they are conveyed along the rails from the lower level to the upper level so that the rims of the containers do not contact the rails.

12. An apparatus as claimed in claim 1, further comprising an ultraviolet irradiation means for sterilizing the rims of the containers as the containers are conveyed along the upper level of the conveyor before being filled.

13. An apparatus as claimed in claim 1, wherein the means for filling the sterile containers comprises a liquid dispensing device having a plurality of nozzles which moves along with the conveyor while filling a plurality of containers simultaneously in a repetitive fashion.

14. An apparatus as claimed in claim 13, wherein the dispensing device has five nozzles for filling five containers simultaneously.

15. An apparatus as claimed in claim 1, wherein the ribbon of cover stock passes through a suitable chemical sterilizing bath prior to being fed over the payout wheel.

16. An apparatus as claimed in claim 15, wherein the sterilizing bath is about 35% hydrogen perioxide in water.

17. An apparatus as claimed in claim 1, wherein the payout wheel and heated sealing wheel both have indexing buttons for engaging and guiding the ribbon of cover stock.

18. An apparatus as claimed in claim 1, further comprising a slightly inclined ramp for the conveyor about the area of the heated sealing wheel for slightly raising the containers as they pass under said wheel thereby ensuring good contact between the container rims and the cover stock being applied.

19. An apparatus as claimed in claim 1, further comprising a slightly upwardly concavely curved ramp for the conveyor beginning just after the heated sealing wheel and ending at the cutoff wheel for slightly tilting the sealed containers toward one another thereby relieving tension on the ribbon of cover stock sealed to said containers prior to severing of the connecting ribbon by the cutoff wheel.

20. An apparatus for packaging an edible liquid in sterile, sealed containers having rims about the openings thereof, comprising:

an endless conveyor having upper and lower levels by which at least one row of containers are conveyed through the apparatus;

means for feeding containers onto the conveyor whereby said containers, being inverted, proceed onto the lower level of the conveyor which is provided with parallel rails for supporting the containers by the rims thereof;

means for sterilizing the containers as they move along the lower level of the conveyor;

means for filling the sterile containers with the liquid as they move along the upper level of the conveyor;

means for sealing the filled containers about the rims thereof, comprising a ribbon of sterile cover stock having a heat sensitive adhesive thereon, being fed over a payout wheel onto a heated sealing wheel for application to the containers;

a cutoff wheel located after the heated wheel for severing the connecting ribbon of cover stock between containers; and a slightly upwardly, concavely curved ramp for the conveyor beginning just after the heated sealing wheel and ending at the cutoff wheel for slightly tilting the sealed containers toward one another thereby relieving tension on the ribbon of cover stock sealed to said containers prior to severing of the connecting ribbon by the cutoff wheel.

21. An apparatus as claimed in claim 20, further comprising a cooling shoe just contacting the tops of the sealed containers and located immediately after the heated sealing wheel.

22. An apparatus as claimed in claim 20, wherein the conveyor comprises a plurality of collars for engaging the rims of the containers, said collars being attached between two parallel chains commonly driven by a sprocket wheel.

23. An apparatus as claimed in claim 20, wherein the conveyor comprises four rows.

24. An apparatus as claimed in claim 20, wherein the means for feeding containers onto the conveyor comprises escapement wheels for delivering individual containers onto individual teeth of a feeder wheel which in turn feeds each container onto the conveyor.

25. An apparatus as claimed in claim 20, wherein the means for sterilization comprises a plurality of nozzles for spraying all surfaces of the containers with a suitable sterilizing solution.

26. An apparatus as claimed including 25, further comprising means for drying the containers after they have been sprayed with sterilizing solution, but before they are filled.

27. An apparatus as claimed in claim 20, further comprising a plurality of nozzles through which sterile air is directed against the containers as they are conveyed along the rails from the lower level to the upper level so that the rims of the containers do not contact the rails.

28. An apparatus as claimed in claim 20, further comprising an ultraviolet irradiation means for sterilizing the rims of the containers as the containers are conveyed along the upper level of the conveyor before being filled.

29. An apparatus as claimed in claim 20, wherein the means for filling the sterile containers comprises a liquid dispensing device having a plurality of nozzles which moves along with the conveyor while filling a plurality of containers simultaneously in a repetitive fashion.

30. An apparatus as claimed in claim 20, wherein the payout wheel and heated sealing wheel both have indexing buttons for engaging and guiding the ribbon of cover stock.

31. An apparatus as claimed in claim 20, further comprising a slightly inclined ramp for the conveyor about the area of the heated sealing wheel for slightly raising the containers as they pass under said wheel thereby ensuring good contact between the container rims and the cover stock being applied.

* * * * *